US006112418A

United States Patent [19]

Strater

[11] Patent Number: 6,112,418

[45] Date of Patent: Sep. 5, 2000

[54] PRECISION SHEARS WITH BREAKAWAY HANDLE

[75] Inventor: William H. Strater, Fontana, Calif.

[73] Assignee: Plato Products, Inc., Industry, Calif.

[21] Appl. No.: 09/069,639

[22] Filed: Apr. 29, 1998

[51] Int. Cl.[7] ..... B25G 1/00; B25B 7/00; B25B 23/153

[52] U.S. Cl. ..... 30/340; 30/254; 30/341; 7/167; 81/471; 81/427.5

[58] Field of Search ..... 30/254, 340, 341, 30/343, 1, 342; 7/167; 81/471, 427.5; 83/543

[56] References Cited

U.S. PATENT DOCUMENTS

| | | | |
|---|---|---|---|
| 3,949,474 | 4/1976 | Sandbrook et al. | 30/341 |
| 4,091,539 | 5/1978 | Watanabe | 30/341 |
| 4,198,749 | 4/1980 | Nordin | 30/192 |
| 4,458,420 | 7/1984 | Davis | 30/342 |
| 4,520,566 | 6/1985 | Davis | 30/342 |
| 5,295,831 | 3/1994 | Patterson et al. | 81/471 |
| 5,778,540 | 7/1998 | Huang | 30/254 |

FOREIGN PATENT DOCUMENTS

| | | | |
|---|---|---|---|
| 640754 | 7/1950 | United Kingdom | 30/341 |

*Primary Examiner*—M. Rachuba
*Assistant Examiner*—Sean Pryor
*Attorney, Agent, or Firm*—Christie, Parker & Hale, LLP

[57] ABSTRACT

Safety shears which include two arms connected by a pin, each arm including a cutting blade and a handle, wherein at least one of the handles includes a weakened portion such that in operation that handle will break before either cutting blade.

13 Claims, 3 Drawing Sheets

PRECISION SHEARS WITH BREAKAWAY HANDLE

BACKGROUND

Precision shears are used for light precision cutting, and are especially useful for cutting thin electrical wire. The blades of such shears are necessarily small, thin, and sharp. Consequently, the amount of stress the blade tips can tolerate before breaking is relatively low. Such shears should not be used to cut wires thicker than that for which they are designed, as the blade tips, which are the weakest portion of the shears, may break off and be propelled in a random direction. Such small, sharp projectiles may injure the user or a bystander. Eye injury is of special concern in considering the safety of precision shears.

Accordingly, it is desirable to provide a safety feature for precision shears to prevent the blade tips from experiencing stress greater than their design limits.

SUMMARY OF THE INVENTION

According to one embodiment of the invention, safety shears are provided which include two arms connected by a pin, each arm including a cutting blade and a handle, wherein at least one of the handles includes a weakened portion such that in operation that handle will break before either cutting blade. Preferably, the weakened portion is a notch in the handle, but it may also be a perforated or thinned portion of the handle. Preferably, the handles are encased in a plastic sheath to prevent the notched handle from separating from the shears when it breaks. Preferably, the area of the weakened portion of the handle is marked on the plastic sheath.

DETAILED DESCRIPTION

Figure 1:
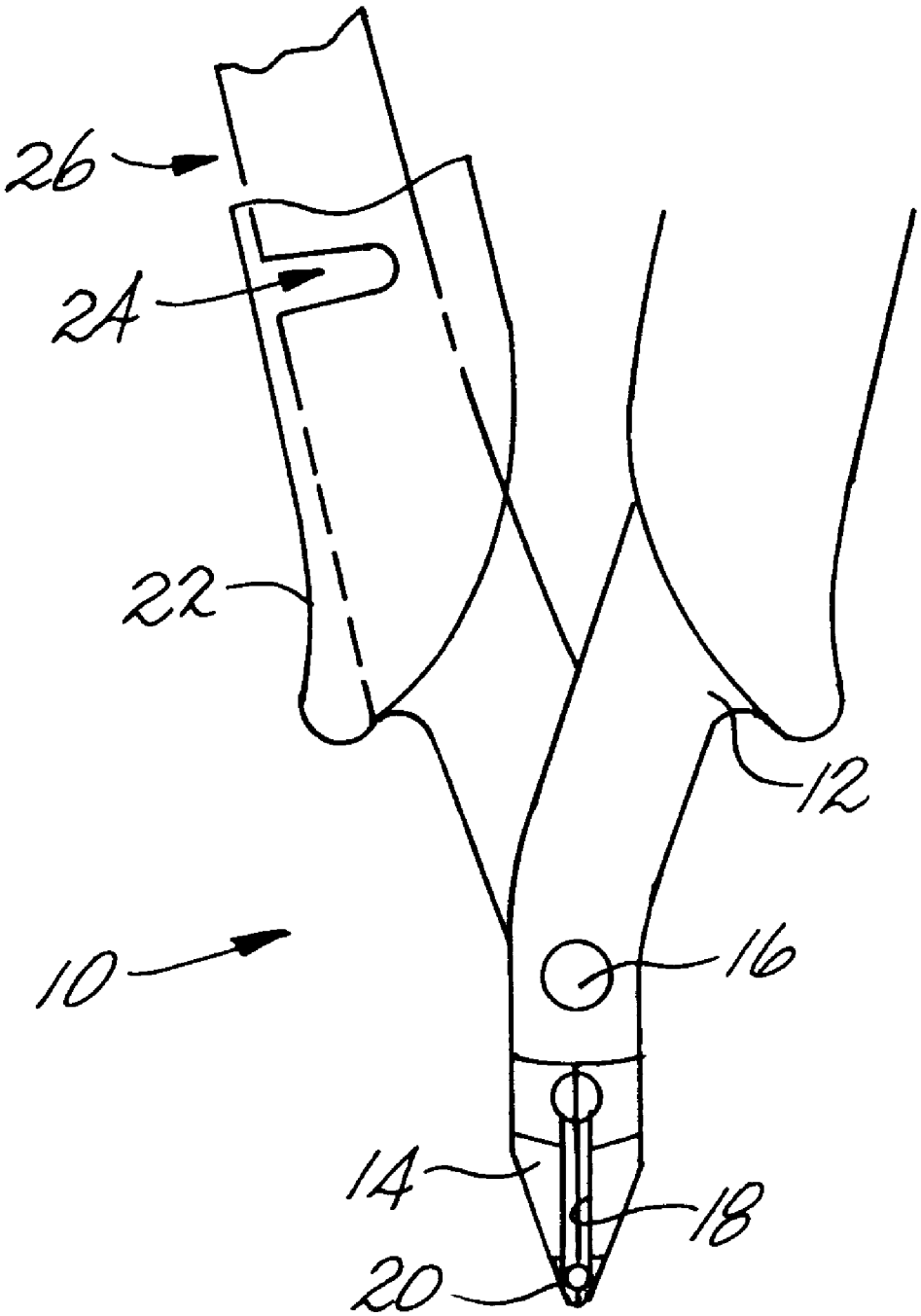
FIG. 1 is a top view of precision shears according to a preferred embodiment of the invention with a notched portion of the shear handle, encased in a plastic sheath, shown in phantom.

FIG. 1 shows precision shears 10 according to a preferred embodiment of the invention. The shears have two arms, each arm including a handle portion 12 and a blade portion 14. The two arms are connected above the blade portion by a pin 16.

The blade portion includes a sharp blade edge 18. Preferably, the handle portion 12 is encased in a rubber or plastic sheath 22.

The blade portion 14 is used for sharp precision cutting of, for example, thin electrical wire. The blades are necessarily small, thin, and sharp. The handle portion 12 on the other hand is thicker and sturdier. Accordingly, the thin blade tip 20 of the blade is more likely than the handle to fracture and break off if the user exceeds a preset design limit of the shears. The design limit is generally measured in terms of wire gauge. If the shears are used to cut a heavier gauge wire, they will likely fail and one of the blade tips 20 will break off, possibly resulting in injury.

According to the preferred embodiment, one handle of the shears is notched so that it is weakened and will fail prior to either blade tip 20 breaking off. Preferably, a notch 24 is positioned on the handle near the pivot 16 and above the gripping portion of the handle, i.e., under the plastic sheath 22. This is the area of highest stress in the handle during cutting. The notch 24 is deep enough to cause failure of the handle when the design limit is exceeded. The depth and position of the notch may be changed depending on the desired design limit for the shears. Preferably, the notch is on an outer edge of the handle. The notch may be a machined, stamped or ground into the handle.

According to one embodiment, the notch is positioned in the handle such that the handle breaks when the shears are used to cut a wire harder or larger than 0.025 inch (25 mil, or 0.6 mm) diameter copper wire, i.e., the shears have a design limit of 25 mil copper wire. If this happens, the shears are inoperable and must be replaced. Of course, other design limits are possible for precision shears according to the invention, depending on the work for which they are designed. Typical design limits range from 0.010 inch to 0.050 inch.

Preferably, the notch 24 is positioned in the area under a plastic sheath 22 to prevent the handle part from separating from the shears when it breaks. Rather, the broken handle portion 26 will be retained in the plastic sheath 22 after breaking so that in operation, when the preset design limitation is exceeded, the handle portion 12 bends, rather than breaking off, thereby making the shears inoperable, at least when using a normal grip. This indicates to the user that the design limit of the shears has been exceeded and has possibly prevented an injury.

Figure 2:
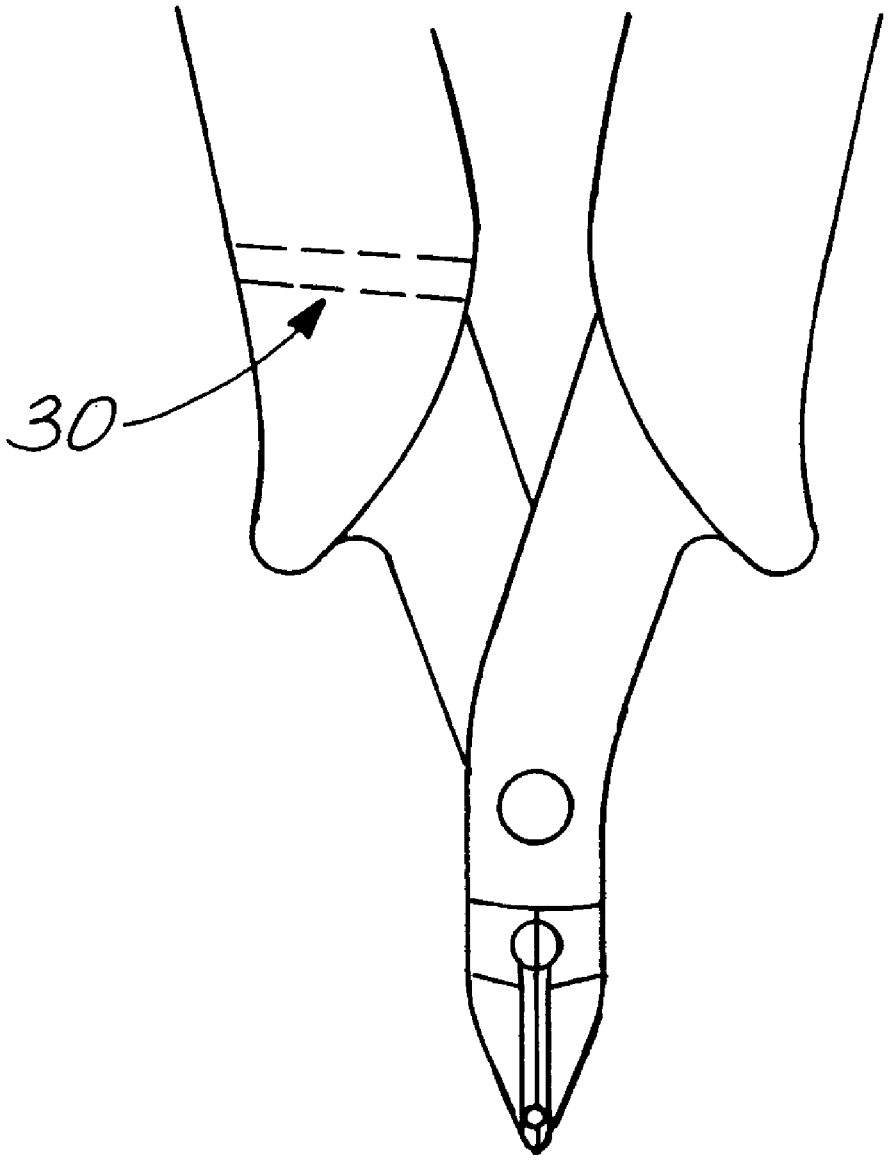
FIG. 2 is a top view of the shears of FIG. 1 with markings on the plastic sheath indicating the area of the handle that will break if the shears are over-stressed.

Preferably, marking lines 30, as shown in FIG. 2, are printed on or etched into the plastic grip to indicate the breakage area. This makes it fairly obvious to a user who exceeds the design limit of the shears that the handle was specifically designed to break even if the user did not know that fact originally.

Figure 3:
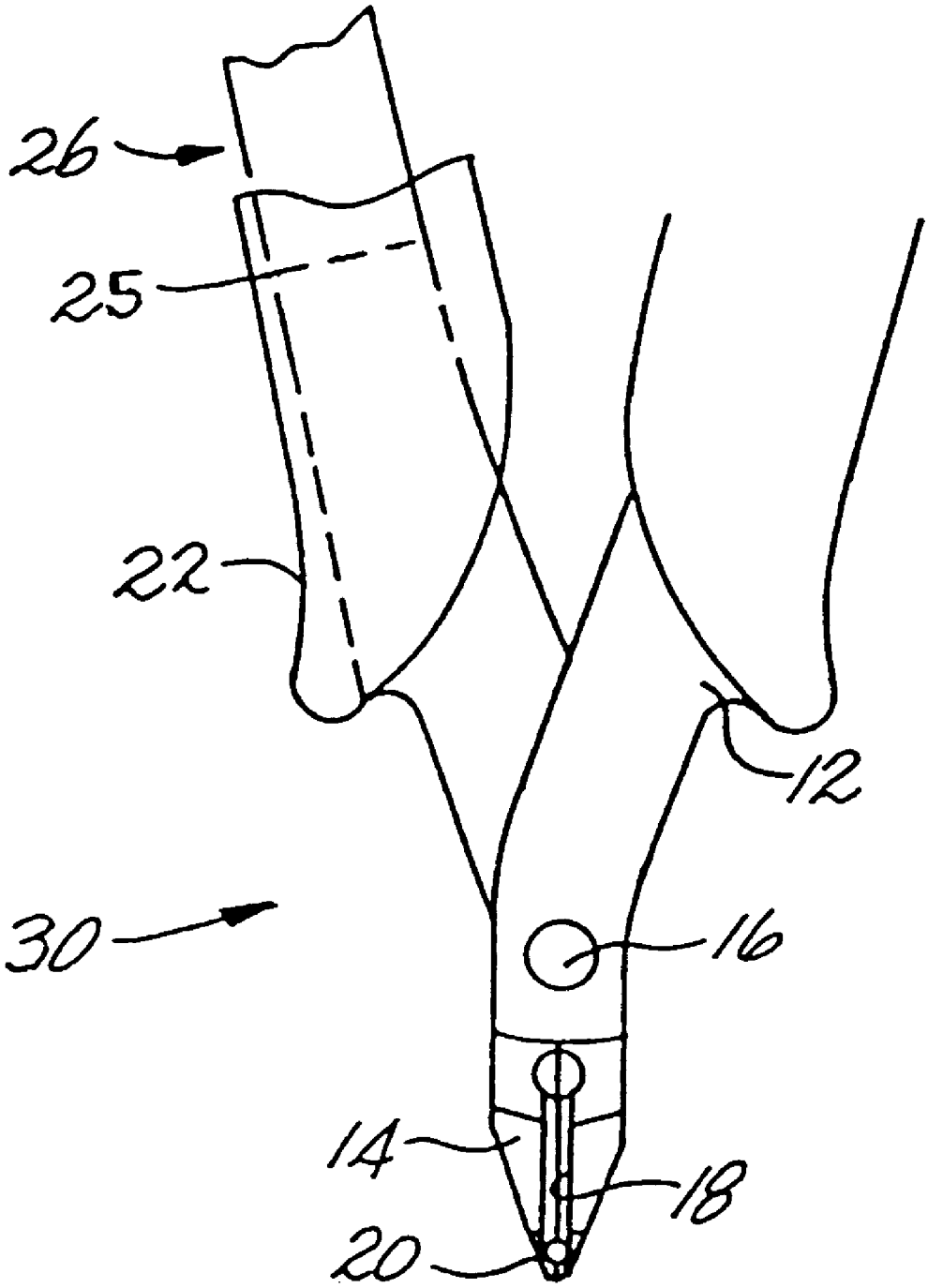
FIG. 3 is a top view of a first alternative embodiment of the shears of FIG. 1

Although the present invention has been described with respect to particular embodiments, those skilled in the art will appreciate that the present invention may be modified without departing from the scope of the invention. For example, FIG. 3 illustrates an alternative embodiment shears 30 wherein the weakened area 25 of the handle may be produced by perforating the handle. Further alternatives include grinding a portion of the handle so that it is thinner, but not notched. Accordingly, all such modifications are intended to be included within the scope of the invention as defined by the following claims.

What is claimed is:

1. Shears comprising:

two arms connected by a pin, each arm comprising a cutting blade and a handle, wherein at least one handle includes a failure portion dimensioned to break before either cutting blade during operation of the handle.

2. The shears of claim 1, wherein the failure portion is a notch in the handle.

3. The shears of claim 1, wherein the handle has a width, and wherein the failure portion is a perforated area extending across the width of the handle.

4. The shears of claim 1, wherein the handle has a thickness, and wherein the failure portion is a portion of the handle having a relatively smaller thickness than the rest of the handle.

5. The shears of claim 1, wherein the failure portion is located between the cutting blades and a gripping portion of the handle.

6. The shears of claim 5, wherein the failure portion is on a side of the handle facing away from the handle on the other arm.

7. The shears of claim 5, wherein the failure portion is on a side of the handle toward the handle on the other arm.

8. The shears of claim 1, wherein the failure portion of the handle is sheathed in a layer of polymeric material.

9. Cutting shears having two bladed handles connected by a pivot, wherein at least one handle includes means for breaking the handle when the shears are used to cut a copper wire having a diameter greater than about 25 mils.

10. Shears comprising:

a first arm and a second arm, each arm comprising, a first end comprising a handle, and a second end comprising a blade, the blades having a thickness such that the blades break when the shears are used to cut wire above a particular gauge, wherein the handle of the first arm includes a notched portion dimensioned to break when the shears are used to cut wire of the particular gauge; and a pin connecting the first arm and a second arm between the first and second ends of each arm.

11. The shears of claim 10, further comprising a sheath encasing the handle of each of said arms.

12. The shears of claim 11, further comprising indicator markings on a portion of the sheath encasing the notched portion of the handle of the first arm.

13. The shears of claim 11, wherein the sheath comprises a material selected from the group consisting of plastic, cork, metal, and rubber.

* * * * *